US009865445B2

(12) United States Patent
Verenchikov et al.

(10) Patent No.: US 9,865,445 B2
(45) Date of Patent: Jan. 9, 2018

(54) MULTI-REFLECTING MASS SPECTROMETER

(71) Applicant: LECO Corporation, St. Joseph, MI (US)

(72) Inventors: Anatoly N. Verenchikov, St. Petersburg (RU); Mikhail I. Yavor, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 14/776,613

(22) PCT Filed: Mar. 14, 2013

(86) PCT No.: PCT/US2013/031506

§ 371 (c)(1),
(2) Date: Sep. 14, 2015

(87) PCT Pub. No.: WO2014/142897

PCT Pub. Date: Sep. 18, 2014

(65) Prior Publication Data

US 2016/0035558 A1 Feb. 4, 2016

(51) Int. Cl.
*H01J 49/40* (2006.01)
*H01J 49/06* (2006.01)

(52) U.S. Cl.
CPC ..... *H01J 49/406* (2013.01); *H01J 49/067* (2013.01); *H01J 49/405* (2013.01)

(58) Field of Classification Search
CPC ..... H01J 49/406
See application file for complete search history.

(56) References Cited

U.S. PATENT DOCUMENTS 7,196,324 B2 * 3/2007 Verentchikov ..... H01J 49/40 250/287
2001/0011703 A1 * 8/2001 Franzen ..... H01J 49/06 250/287

(Continued)

FOREIGN PATENT DOCUMENTS

CN 1853255 A 10/2006
CN 101171660 A 4/2008

(Continued)

OTHER PUBLICATIONS

Chinese Office Action for the related Application No. 201380074507.5 dated Jun. 3, 2016.

(Continued)

*Primary Examiner* — Michael Logie
(74) *Attorney, Agent, or Firm* — Honigman Miller Schwartz and Cohn LLP

(57) ABSTRACT

To improve spatial and energy acceptance of multi-reflecting time-of-flight, open traps, and electrostatic trap analyzers, a novel ion mirror is disclosed. Incorporation of immersion lens between ion mirrors allows reaching the fifth order time per energy focusing simultaneously with the third order time per spatial focusing including energy-spatial cross terms. Preferably the analyzer has hollow cylindrical geometry for extended flight path. The time-of-flight analyzer preferably incorporates spatially modulated ion mirror field for isochronous ion focusing in the tangential direction.

23 Claims, 14 Drawing Sheets

(56) References Cited

U.S. PATENT DOCUMENTS

| | | | | |
|---|---|---|---|---|
| 2006/0214100 | A1* | 9/2006 | Verentchikov | H01J 49/406 250/287 |
| 2007/0029473 | A1* | 2/2007 | Verentchikov | H01J 49/406 250/281 |
| 2011/0017907 | A1* | 1/2011 | Makarov | H01J 49/406 250/282 |
| 2011/0186729 | A1* | 8/2011 | Verentchikov | H01J 49/406 250/282 |
| 2016/0035558 | A1* | 2/2016 | Verenchikov | H01J 49/405 250/287 |

FOREIGN PATENT DOCUMENTS

| | | | | |
|---|---|---|---|---|
| GB | 2403063 | A | 12/2004 | |
| JP | 2007526596 | A | 9/2007 | |
| JP | 2008535164 | A | 8/2008 | |
| JP | 2011528487 | A | 11/2011 | |
| RU | WO 2011135477 | A1 * | 11/2011 | H01J 49/0031 |
| SU | 1725289 | A1 | 4/1992 | |
| WO | WO-2013/063587 | A2 | 5/2013 | |

OTHER PUBLICATIONS

International Search Report dated Jan. 16, 2014, relating to International Application No. PCT/US2013/031506.

"Planar multi-reflecting time-of-flight mass analyzer with a jig-saw ion path", Yavor, M. et al, Physics Procedia, Elsevier, Amsterdam, NL, vol. 1, No. 1, Aug. 1, 2008.

"Ion optics with electrostatic lenses", F. Hinterberger, retrieved from http://cds.cern.ch/record/1005034/file, Jan. 1, 2005.

Japanese Office Action for the related Application No. 2016-500048 dated Sep. 20, 2016.

* cited by examiner

*Fig. 1; Prior Art MPA-1*

*Fig. 2; Prior Art MPA-1*

*Fig. 3; Prior Art MPA-2*

*Fig. 4; Prior Art MPA-2*

*Fig. 5; Prior Art MPA-2-3*

*Fig. 6; Prior Art MPA-2-4*

*Fig. 7; Prior Art MPA-2-5*

MULTI-REFLECTING MASS SPECTROMETER

TECHNICAL FIELD

This disclosure relates to the area of mass spectroscopic analysis, multi-reflecting time-of-flight mass spectrometers and electrostatic traps and to the related apparatus, including electrostatic ion mirrors.

BACKGROUND

Multi-reflecting mass spectrometers, either time-of-flight (MR-TOF MS), open traps, or electrostatic traps (E-trap), comprise gridless ion mirrors to arrange isochronous motion of ion packets, essentially independent of ion energy and spatial spreads.

An important class of ion mirrors for multi-reflecting mass spectrometers is represented by mirrors which are substantially elongated in one transverse direction Z to form a two-dimensional electrostatic field. This field can have either planar or hollow cylindrical symmetry. SU1725289, incorporated herein by reference, introduces an MR TOF MS with ion mirrors of planar symmetry. Except Z-edges, the electrostatic field is two-dimensional E(X, Y), i.e. essentially independent of the Cartesian coordinate Z Ions move along zigzag trajectories, being injected at small angle to X-axis, periodically reflected from the mirrors in the X-direction, spatially focused in the Y-direction, and slowly drifting in the Z-direction. U.S. Pat. No. 7,196,324, GB2476964, GB2477007, WO2011086430, and co-pending application 223322-313911,incorporated herein by reference, disclose multi-reflecting analyzers with hollow cylindrical mirrors formed by two sets of coaxial ring electrodes. Contrary to planar mirrors, cylindrical mirrors eliminate Z-edges, thus forming electrostatic field completely independent on the azimuthal Z-direction. The analyzer provides a compact folding of ion path per instrument size. However, when arranging zigzag ion trajectories, the ion path deviates from a cylindrical surface, which demands for ion mirrors being highly isochronous relative to radial Y-displacements.

Electrostatic multi-reflecting analyzers with two-dimensional ion mirrors of both—planar and hollow cylindrical geometry are disclosed for use as time-of-flight analyzers (SU1725289, U.S. Pat. No. 7,385,187), open traps (GB2478300, WO2011107836), and electrostatic traps (GB2476964, GB2477007, WO2011086430). While in time-of-flight (TOF) analyzers ion packets travel towards a fast response detector along a fixed path, in electrostatic traps, the ion packets are trapped indefinitely. They keep reflecting while being detected by image current detector. Open electrostatic traps could be considered as a hybrid between TOF and traps. Ions reach a detector after a loosely defined number of reflections within some span in the number of reflections.

Multi-reflecting time-of-flight mass spectrometers can be combined with a set of periodic lenses to confine ions in the Z-direction, as disclosed in GB2403063 and U.S. Pat. No. 7,385,187,incorporated herein by references. US2011186729, incorporated herein by reference, discloses quasi-planar ion mirrors, in which the electrostatic field of planar symmetry is superimposed with a weak field spatially periodic in the Z-direction to provide ion confinement in this direction. Such periodic field, by itself or in combination with periodic lenses, allows significant reducing of flight time distortions due to the spatial Z-spread in ion bunches. GB2476964, GB2477007, WO2011086430, incorporated by reference, disclose periodic lens in the tangential direction within cylindrical hollow analyzers.

The general trend in design of multi-reflecting mass spectrometers is to minimize the effect of ion packet broadening during periodic ion motion between the mirrors in order to increase the mass resolving power of the spectrometer at given energy tolerance and phase space acceptance, i.e. acceptance of initial spatial, angular, and energy spreads of ion packets. In order to improve the energy tolerance of the mass analyzer, U.S. Pat. No. 4,731,532, incorporated herein by reference, discloses a gridless ion mirror with a purely retarding field which provides for second-order focusing of the flight time T with respect to kinetic energy K, i.e. $dT/dK=d^2T/dK^2=0$. Since present invention is primarily concerned with analyzer isochronicity we will be referring time-per-energy focusing as "energy focusing". In the paper by A. Verenchikov et al., Technical Physics, v. 50, N1, 2005, p. 73-81, incorporated herein by references, planar ion mirrors are described with an accelerating potential at one of the mirror electrodes, which provide for third-order energy focusing, i.e. for $dT/dK=d^2T/dK^2=d^3T/dK^3=0$. Co-pending application 223322-318705, incorporated herein by reference, discloses gridless ion mirrors of either planar or hollow cylindrical geometry, possessing fourth ($d^4T/dK^4=0$) and fifth ($d^5T/dK^5=0$) order energy focusing. Achieving high order of energy focusing allows increasing the energy tolerance of the mass analyzer to >10% at mass resolving power above 100,000.

Since in gridless ion mirrors due to an inhomogeneous field structure ion flight time in general depends not only on ion energy but also on ion initial coordinate and direction of motion, it is important to design ion mirrors such to provide for periodic focusing of the flight time with respect to the spatial spread of ion packets. In general, for two dimensional and Z-independent fields with X-direction for ion reflections, the flight time T through the analyzer depends on ion kinetic energy K, initial spatial coordinate $Y_0$ and angular coordinate $b_0$ ($b=dY/dX$). At small deviations of initial ion parameters the time-of-flight deviations can be represented by the Taylor expansion:

$$y = (T\,|\,\delta)\delta + (T\,|\,\delta\delta)\delta^2 + (T\,|\,\delta\delta\delta)\delta^3 + (T\,|\,\delta\delta\delta\delta)\delta^4 + (T\,|\,\delta\delta\delta\delta\delta)\delta^5 + \ldots + (T\,|\,yy)y_0^2 + (T\,|\,yb)y_0b_0 + (T\,|\,bb)b_0^2 + (T\,|\,yy\delta)y_0^2\delta + (T\,|\,yb\delta)y_0b_0\delta + (T\,|\,bb\delta)b_0^2\delta + \ldots$$

where $t=(T-T_0)/T_0$ is the relative flight time deviation, $T_0$ is the flight time corresponding to an ion with zero initial coordinates $Y_0=B_0=0$ and with the mean kinetic energy value $K_0$, $\delta=(K-K_0)/K_0$ is the relative energy deviation, and $y=Y/H$ is the coordinate normalized to the window height H of the ion mirror. The expansion (aberration) coefficients ( . . . | . . . ) are normalized derivatives: $(t|\delta)=dt/d\delta$, $(t|\delta\delta)=(1/2)d^2t/d\delta^2$ etc. N-th order energy focusing means that all coefficients at the pure powers of δ up to N-th power inclusively are zeroes. The second order spatial focusing (i.e. time-of-flight focusing with respect to spatial and energy spreads) means that $(t|yy)=(t|yb)=(t|bb)=0$, because the mixed second order terms $(t|y\delta)$ and $(t|b\delta)$ vanish due to the system symmetry with respect to the plane Y=0.

The paper by M. Yavor et al., Physics Procedia, v. 1 N1, 2008, p. 391-400, incorporated herein by reference, provides details of geometry and potentials for planar ion mirrors which simultaneously provide the third order energy focusing, second order spatial focusing and geometrical focusing in Y-direction. In such analyzers, the broadening of ion packets in the mirror fields is dominated by so-called "mixed" third order aberrations due to both spatial and energy spreads, i.e. terms $(t|yy\delta)y_0^2\delta$, $(t|yb\delta)y_0b_0\delta$ and $(t|bb\delta)b_0^2\delta$, because the rest third order aberrations vanish due to the system symmetry with respect to the plane Y=0. These terms are responsible for deterioration of the resolving power of multi-reflection mass spectrometers at both FWHM level and even more severely at the 10% peak height level. This deterioration is especially noticeable in hollow cylindrical analyzers in which ions are periodically shifted in radial Y-direction from the "ideal" cylindrical surface of ion motion, as well as in planar mass analyzers with periodic lenses, in which ions are injected with a large enough Y-spread through a "double orthogonal" accelerator described in US2007176090, incorporated herein by reference.

As described in the co-pending application 223322-318705, incorporated herein by reference, the order of energy focusing can be increased by optimizing the electrostatic potential distribution in the region of ion reflection. The improvement is reached by increasing the number of mirror electrodes with different electrode potentials and choosing sufficiently thin electrodes in the region of ion reflection. This strategy of design, however, fails in case one wants to achieve high order energy focusing simultaneously with high order spatial focusing. Up to fifth-order energy focusing may be achieved in combination with the second-order spatial focusing. To obtain third-order energy focusing in combination with the third-order spatial focusing one has to increase the width of the mirror electrode with accelerating potential, though such geometry modification causes a negative consequence of reducing the spatial acceptance of the ion mirror. However, our own thorough numerical simulations of gridless ion mirrors show that no straightforward steps like increasing the number of mirror electrodes, splitting them into parts with introducing more independent electrode voltages, varying their widths and shapes and other similar means do not lead to elimination of the mixed (energy-spatial) third order aberrations in ion mirrors with the fourth and higher order of energy focusing. Using the above mentioned optimization procedures one can reach high-order energy isochronicity, however, at a cost of increasing mixed third order aberrations. In other words, increasing the energy acceptance leads to reduction of the spatial acceptance.

Thus, prior art ion mirrors possess either high energy acceptance or high spatial acceptance but not both at the same time. Therefore, there is a need for improving the spatial phase space acceptance of ion mirrors possessing high energy tolerance, i.e. flight time focusing with respect to energy of fourth and higher orders.

SUMMARY

The inventors have realized that the spatial acceptance of planar time-of-flight mass analyzers can be increased while maintaining high order time per energy focusing by adding a planar lens between prior art ion mirrors, which may include the following:

(a) said mirrors have accelerating and reflecting electrostatic field regions;

(b) said planar lens focuses ions in the same Y-direction as the mirrors do;

(c) the lens pre-focuses ions to the region of the retarding mirror field;

(d) the mirror and lens fields are separated by a field-free space; and (e) said lens is immersion, that is, ions are accelerated by the lens in the direction towards the mirror and decelerated on the way back. This also means that ions pass the field-free space between the lens and the mirror at an increased energy as compared to ion energy outside the "mirror plus lens" pair.

Therefore, in the invented configuration there are in general two lens regions formed in each mirror-lens combination: the pre-focusing lens and the "internal" lens formed by the accelerating electrode of ion mirror. So, on the way to the ion mirror ions are accelerated twice: first, by the pre-focusing lens and then by the field of the mirror accelerating electrode. After passing the latter field ions are reflected by the retarding field of the mirror.

The reduction of the flight time aberrations due to spatial ion spreads in Y-direction by providing means of shrinking Y-widths of ion bunches inside the mirror reflecting field could be expected by those experienced in the art. It is important to emphasize, however, that the pre-focusing lens itself introduces additional aberrations, and numerous calculations show that the positive effect of focusing is modest and expectations are not met if using just an arbitrary pre-focusing lens. The principal and unobvious point of the invention is that an efficient reduction of mixed third order aberrations in the mirror-lens combinations occurs only in case when the pre-focusing lens is immersion (accelerating ions on the way to the mirror). Though inventors do not know a strict mathematical proof, thorough numerical simulation of various mirror-lens combinations confirm this conclusion.

In an embodiment, there is provided isochronous time-of-flight or electrostatic trap analyzer comprising:

(a) Two parallel and aligned grid-free ion mirrors separated by a filed free region, said mirrors being arranged to reflect ions in a first X-direction, said mirrors being substantially elongated in the transverse drift Z-direction to form a two-dimensional electrostatic field either of planar symmetry or of a hollow cylindrical symmetry;

(b) Said mirrors having at least one electrode with an accelerating potential compared to the field-free space potential, arranged to geometrically focus ions in the Y-direction; and (c) At least one planar electrostatic lens, arranged to geometrically focus ions in the Y-direction, said lens being elongated in said transverse Z-direction and placed between said ion mirrors.

Preferably, said lenses are immersion. In an implementation, said mirrors are preferably symmetric with respect to the median plane X=0 of the analyzer. In an implementation, there are preferably two said planar lenses, identical and located symmetric with respect to the median plane of the analyzer, one at each side of said median plane. In this case, three field-free regions are formed: one between said pre-focusing lenses and two between said lens and said mirror. In an implementation, said two field free regions between lens and ion mirror have higher accelerating potential as compared to the field free region between said lenses.

In an implementation, a single pre-focusing lens field can be superimposed with the fields of periodic lenses placed between ion mirrors and arranged for confining ions in the drift Z-direction. In this case, instead of planar lenses, the array of periodic lenses is composed of lenses with 3D field, focusing ions in both transversal directions Y and Z.

In an implementation, electrostatic field of one or both mirrors of planar or hollow cylindrical symmetry can be superimposed with a weak field being periodic in the direction Z of elongation of the mirrors to provide ion confinement in the Z-direction. Preferably, said spatially modulated electrostatic field by itself or in combination with a periodic lens is such that it eliminates time per spatial aberrations in the Z-direction.

BRIEF DESCRIPTION OF THE DRAWINGS

Various embodiments of the present invention together with arrangement given illustrative purposes only will now be described, by way of example only, and with reference to the accompanying drawings in which.

A—"ideal" analyzer possessing no time-of-flight aberrations;

B—mass analyzer with the mirrors MPA-1;

C—mass analyzer with the mirrors MPA-2 in the $3^{rd}$ order focusing mode MPA-2-3;

D—mass analyzer with the mirrors MPA-2 in the $5^{th}$ order focusing mode MPA-2-5;

E—mass analyzer with the mirror-lens combinations ML-2.

Peak shapes are calculated at time focus positions. Analyzers are scaled such that to maintain the same flight time $T_0$. In all cases ion packets have the same relative initial spreads: Gaussian energy distribution at $\sigma_K=0.011K_0$, uniform Y-distribution at full height of $2Y_0=0.133H$, and Gaussian distribution of ion start times, corresponding to the mass resolving power of $R_m=T_0/(2\Delta T_1)=300\ 000$ at FWHM.

Figure 14:
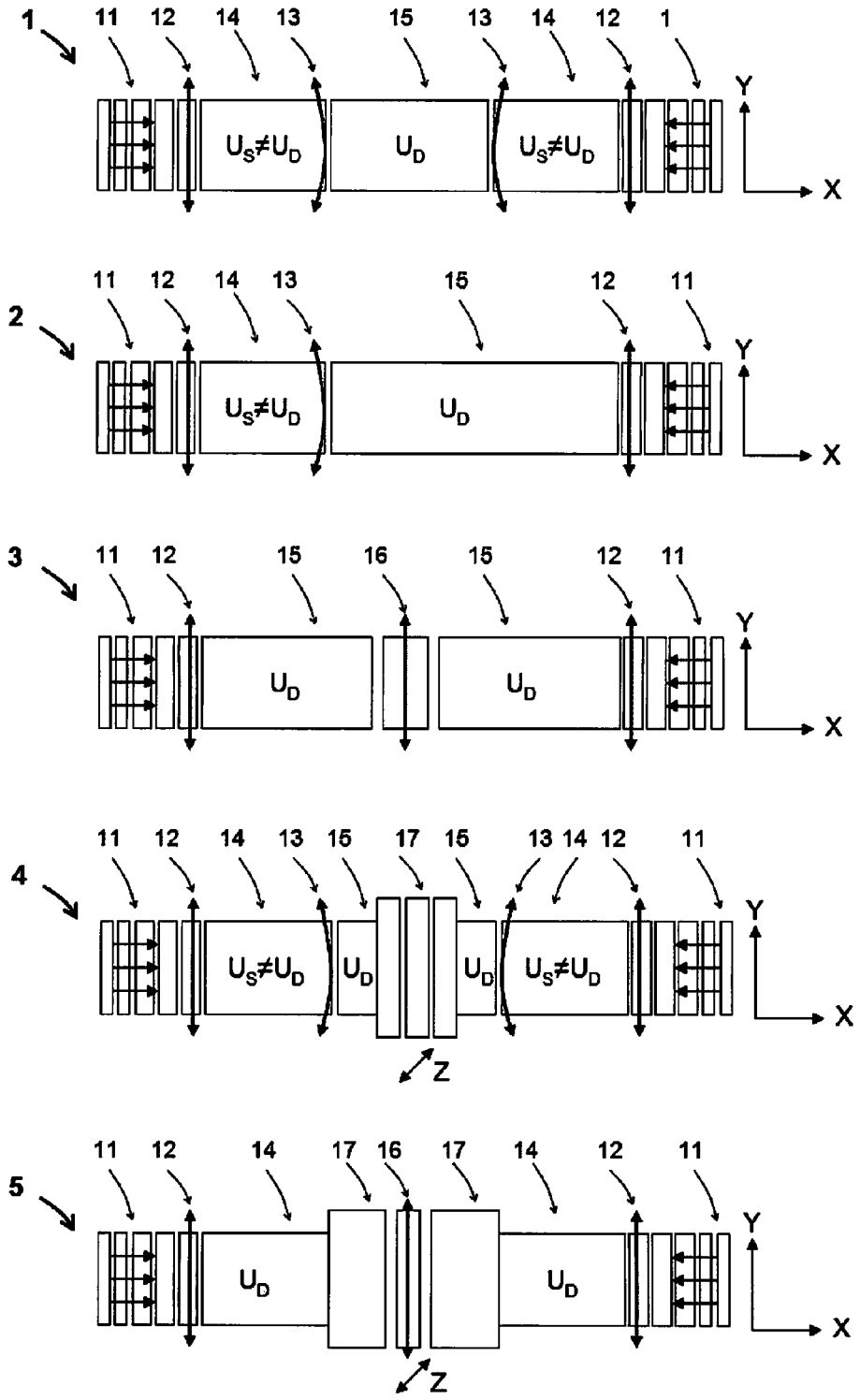

FIG. 14 presents a block schematic view of mirror-lens combinations of the present invention.

DETAILED DESCRIPTION

As disclosed in GB2403063 and U.S. Pat. No. 7,385,187, incorporated herein by references, a multi-reflecting time-of-flight analyzer of prior art comprises two ion mirrors, elongated in a drift Z-direction, turned face-to-face and separated by a drift space. The ion packets move along zigzag trajectories, being periodically reflected in the X-direction between the mirrors. Zigzag trajectories are arranged by injecting ions at small angle to the X-axis and by spatial ion confinement in a periodic lens.

Figure 1:
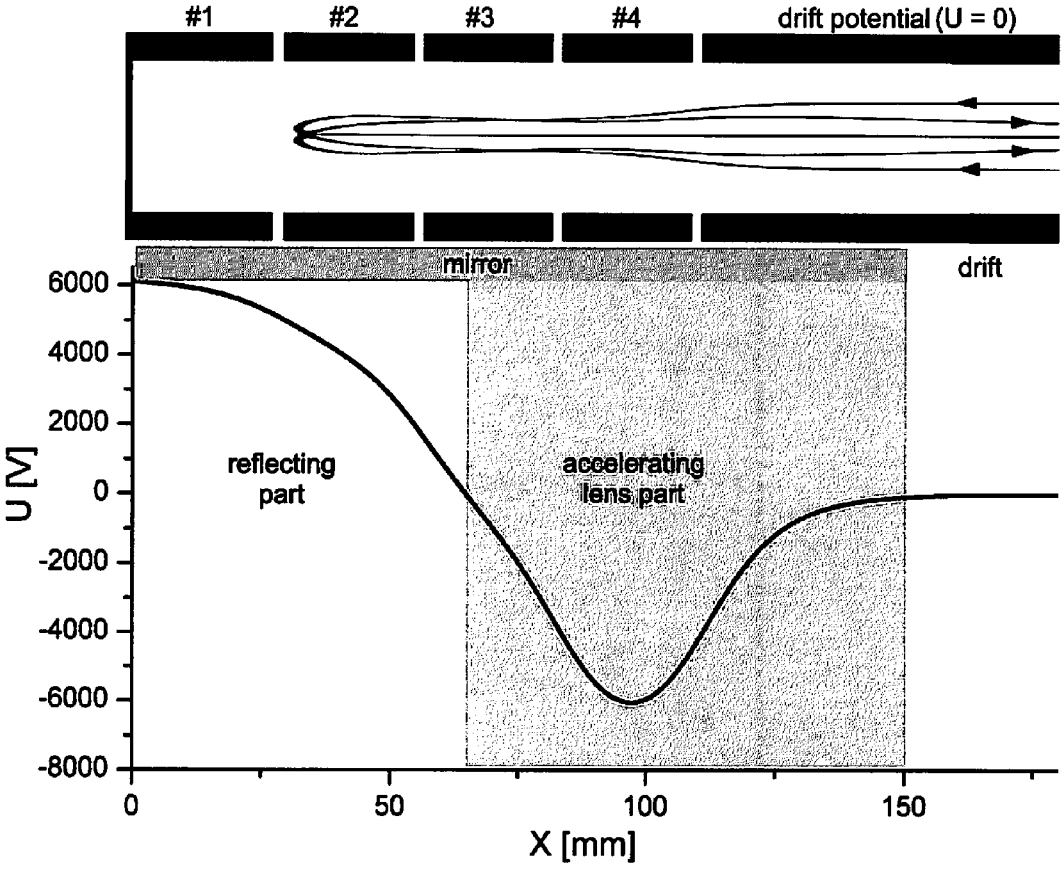
FIG. 1 depicts a four-electrode planar ion mirror of prior art (MPA-1) with the third order energy focusing, the second order spatial focusing, and compensated second order mixed aberrations. Sample ion trajectories and electrostatic potential U(X) distribution in the middle plane (Y=0) are drawn for mean kinetic ion energy per charge ratio $K_0/Q=4500$ V.

Referring to FIG. 1, a planar mirror of U.S. Pat. No. 7,385,187 (MPA-1) is shown at XY plane which is orthogonal to the Z-direction of mirror elongation. The electrostatic field is formed by applying voltages to four electrodes (#1-#4). The distance between outer cap electrodes (electrodes #1) is $2X_0$. The Table 1 presents electrode X-widths L, normalized to the Y-height H of the mirror window, so as electrode potentials normalized to $K_0/Q$, where Q is the ion charge and $K_0$ is the mean ion kinetic energy in field-free space. The electrostatic potentials are retarding at the electrodes #1 and #2, nearly drift potential at the electrode #3, and accelerating at the electrode #4 (see Table 1). Though prior art analyzers operate at floated drift space, for simulation purposes the drift potential is set to zero (U=0 in FIG. 1) and mirror potentials are shifted by $K_0/Q$, i.e. experimentally used normalized potentials are less by 1 as compared to simulated ones.

TABLE 1

Geometry and electrode potentials for the prior art mirror MPA-1

| Electrode | #1 | #2 | #3 | #4 |
|---|---|---|---|---|
| Normalized width, L/H | 0.917 | 0.917 | 0.917 | 0.917 |
| Normalized potential, $UQ/K_0$ | 1.361 | 0.969 | −0.139 | −1.898 |

Again referring to FIG. 1, axial electrostatic potential distribution U(X, Y=0) for MPA-1 shows that the mirror field consists of two regions—the region of accelerating field (U<0 for positive ions) and the region of the reflecting field (U>0 for positive ions) for a particular ion mirror with $X_0$=308 mm and H=30 mm. The region of the accelerating field performs a geometrical ion focusing in the Y-direction, as seen from sample ion trajectories. The focusing strength is tuned by adjusting potential #4 such that parallel ion beam entering the mirror is focused such that it returns into a point (in paraxial approximation) at the middle plane of the analyzer. Such geometrical focusing provides transformation of an ion trajectory to itself after four mirror reflections. The ion-optical and isochronous properties of the time-of-flight analyzers with MPA-1 mirrors, have been described in detail, e.g. in the paper by M. Yavor et al., Physics Procedia, v. 1 N1, 2008, p. 391-400, incorporated herein by reference. The proper tuning of the mirrors simultaneously provides the following properties at the middle plane of the analyzer: the above mentioned geometric focusing in the Y-direction; the third order energy focusing $(t|\delta)=(t|\delta\delta)=(t|\delta\delta\delta)=0$ after each ion reflection; and second order spatial focusing $(t|y)=(t|b)=(t|y\delta)=(t|b\delta)=(t|yy)=(t|yb)=(t|bb)=0$ after two mirror reflections.

Figure 2:
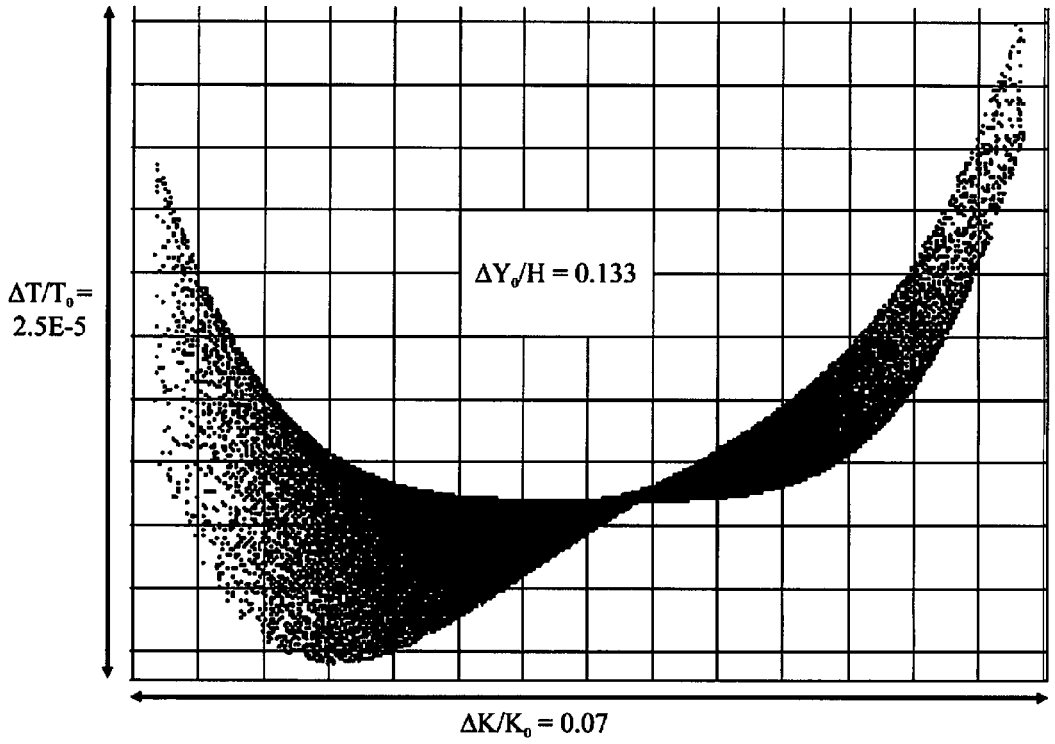
FIG. 2 shows typical flight time broadening in prior art ion mirrors MPA-1 of FIG. 1 as a function of ion energy in case of finite energy K- and spatial Y-spreads of ion bunches.

Referring to FIG. 2, a simulated plot of ion distribution in the normalized time-energy plane is shown at a time focal plane (located at the middle plane of the analyzer) after even number of mirror reflections in MPA-1 analyzer of FIG. 1. Initial ion bunch has Gaussian energy distribution at $\sigma_K=0.011K_0$ and uniform Y-distribution at full height of $2Y_0=0.133H$. The plot characterizes maximal $\Delta T/T_0\sim 2.5\times 10^{-5}$ ion bunch broadening due to analyzer aberrations. The points corresponding to individual "probe" ions are mostly enclosed between two curves: $(T-T_0)/T_0=(t|\delta\delta\delta\delta)\delta^4$ and $(T-T_0)/T_0=(t|\delta\delta\delta\delta)\delta^4+(t|yy\delta)y_0^2\delta$, composed of energy and third order mixed aberrations. With good accuracy, the aberrations $(t|\delta\delta\delta\delta)\delta^4$ and $(t|yy\delta)y_0^2\delta$ dominate in broadening of time-of-flight peaks. The values of the corresponding and some higher ($5^{th}$ and $6^{th}$) order energy aberration coefficients are presented in Table 2.

TABLE 2

Aberration coefficients of the mass analyzer with the mirrors MPA-1

| Aberration coefficient | Value |
|---|---|
| $(t \mid \delta\delta\delta\delta)$ | 11.5 |
| $(t \mid \delta\delta\delta\delta\delta)$ | 8.50 |
| $(t \mid \delta\delta\delta\delta\delta\delta)$ | −115.3 |
| $(t \mid yy\delta)$ | 0.0727 |

Based on aberration coefficient values one can calculate magnitudes of time spread induced by aberrations for given values of energy and coordinate spreads. For example, let the total flight time be $T_0$=1 ms and consider an ion bunch of FIG. 2 with Gaussian energy distribution at $\sigma_K=0.011$ and with the uniform coordinate spread of $Y_0/H=\pm 0.067$. Then, about 95% ions deviate from the mean energy by less than $\delta=2\sigma_K=\pm 0.022$, i.e. stay within the total energy spread of 4.4%. Due to the fourth order aberration $(t|\delta\delta\delta\delta)\delta^4$ the maximum deviation of the normalized flight time equals $11.5*0.022^4\approx 2.6E-6$ and the absolute time spread is 2.6 ns. Similarly, the $5^{th}$ order aberration $(t|\delta\delta\delta\delta\delta)\delta^5$ contributes $8.5*2*0.022^5\approx 9E-8$, corresponding to 0.09 ns. Additional factor of 2 appears since deviations of opposite signs are summed for odd order aberrations. The coordinate spread contributes to the flight time spread mainly due to the mixed aberration $(t|yy\delta)y_0^2\delta$ as $0.0727*0.067^2*2*0.022\approx 1.4E-5$ and absolute value 14 ns.

Figure 3:
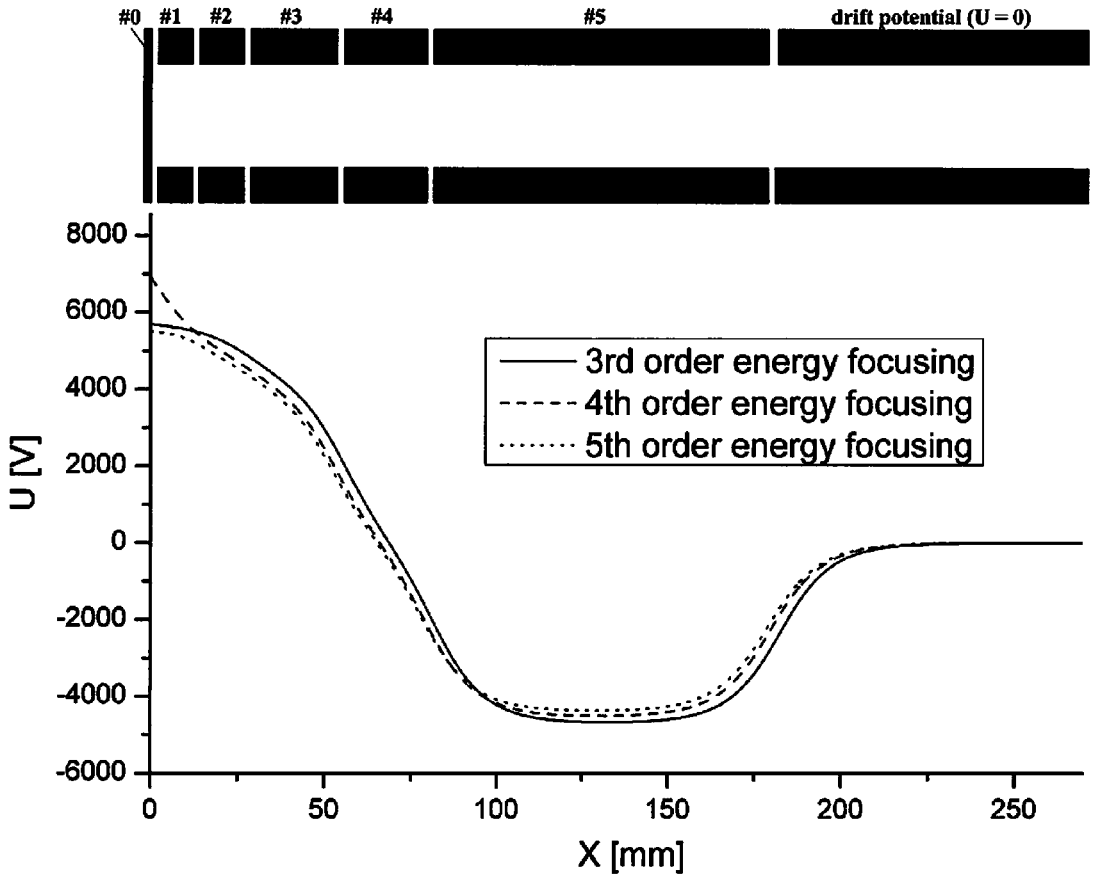
FIG. 3 depicts an ion mirror of prior art (MPA-2) capable of reaching the fifth order energy focusing. The electrostatic potential U(X, Y=0) distributions for $K_0/Q=4500$ V are presented for three tuning modes MPA-2-3, MPA-2-4 and MPA-2-5, corresponding to the third, fourth and fifth-order energy focusing. Between tuning modes, lower order energy-focusing allows better compensation of spatial and mixed term aberrations.

Referring to FIG. 3, another ion mirror of prior art (MPA-2) is shown, wherein the corresponding time-of-flight mass analyzer is composed of two such mirrors, placed face-to-face and separated by a drift space. The mirror is described in a co-pending application 223322-318705, incorporated herein by reference. The mirror provides for the fifth order energy focusing $(t|\delta)=(t|\delta\delta)=(t|\delta\delta\delta)=(t|\delta\delta\delta\delta)=(t|\delta\delta\delta\delta\delta)=0$. To this goal, the mirror cap is separated from the electrode #1 and forms a separate electrode #0, retarding voltages are applied to the electrodes #1, #2 and #3, the field-free potential (U=0 in FIG. 3) is applied to the electrode #4, and an accelerating potential is applied to the electrode #5. The mirror sizes and the electric tuning of the mirror electrodes in the fifth order energy focusing mode (MPA-2-5) are presented in Table 3, in which the cap-to-cap separation is $2X_0$=908 mm and the height of the mirror window is H=30 mm.

TABLE 3

Geometry and electrode potentials for the prior art mirror MPA-2

| Electrode | | #0 | #1 | #2 | #3 | #4 | #5 |
|---|---|---|---|---|---|---|---|
| Normalized width, L/H | | — | 0.433 | 0.484 | 0.933 | 0.883 | 3.342 |
| Normalized potential, $UQ/K_0$ | 5 order energy focusing (MPA-2-5) | 1.222 | 1.387 | 1.059 | 0.919 | 0 | −0.977 |
| | 4 order energy focusing (MPA-2-4) | 1.539 | 1.116 | | 0.943 | 0 | −1.009 |
| | 3 order energy focusing (MPA-2-3) | | 1.267 | | 0.981 | 0 | −1.046 |

By electrically connecting adjacent electrodes, the number of independently adjusted voltages can be reduced, and the mirror MPA-2 can be tuned such that the order of energy focusing can be decreased to the fourth one $(t|\delta)=(t|\delta\delta)=(t|\delta\delta\delta)=(t|\delta\delta\delta\delta)=0$ (mode MPA-2-4) or to the third one $(t|\delta)=(t|\delta\delta)=(t|\delta\delta\delta)=0$ (mode MPA-2-3). The corresponding modes of electric tuning are shown in Table 3 and the potential distributions U(X, Y=0) are shown in FIG. 3.

Referring to Table 4, in our own simulations we found that sacrificing the energy focusing allows simultaneous reduction of the mixed third order aberrations. As an example, the geometry and potentials of mirror MPA-2 are optimized such that in the third order energy focusing mode MPA-2-3 there are reached: second order spatial focusing $(t|y)=(t|b)=(t|yy)=(t|yb)=(t|bb)=0$; and mixed third order aberrations are eliminated: $(t|yy\delta)=(t|y\delta)=(t|bb\delta)=0$. This means the full third order focusing of the flight time, because all the remaining third order aberration coefficients in the analyzer vanish automatically because of the system symmetry with respect to the Y=0 plane. The dominating non-vanishing aberration in this case remains the fourth order aberration $(t|\delta\delta\delta\delta)\delta^4$.

TABLE 4

| Aberration coefficients of the mass analyzer with the mirrors MPA-2 | | | |
|---|---|---|---|
| | Value | | |
| Aberration coefficient | 5 order energy focusing (MPA-2-5) | 4 order energy focusing (MPA-2-4) | 3 order energy focusing (MPA-2-3) |
| (t \| δδδδ) | 0 | 0 | 26.0 |
| (t \| δδδδδ) | 0 | −118.0 | 42.7 |
| (t \| δδδδδδ) | 646.2 | −186.8 | −437.6 |
| (t \| yyδ) | 0.0270 | 0.0165 | 0 |

Figure 4:
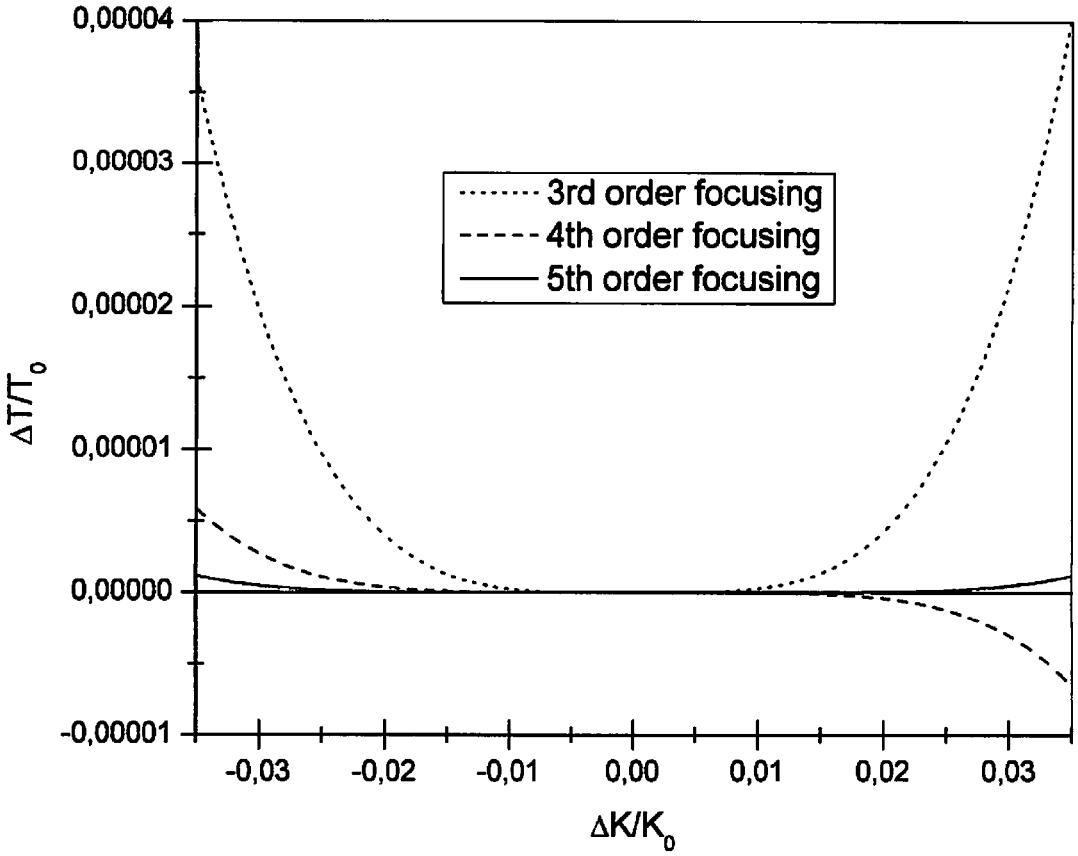
FIG. 4 plots ion flight time Vs ion energy at Y=0 for prior art ion mirrors MPA-2 of FIG. 3 at three above mentioned tuning modes.

Referring to FIG. 4, the dependencies of the flight time on ion energy are plotted in the three above discussed modes. These dependencies show that if the mixed third order aberrations could be neglected, increasing the order of energy focusing would lead to significant reduction of the time peak broadening. For an exemplar 7% energy spread, proceeding from the third to fourth and then to fifth order energy focusing drops the time spread 3 and 30 times correspondingly. However, as shown in Table 4, increasing the energy focusing order causes growth of the third order mixed aberration (t|yyδ), which reduces improvement of the overall time peak broadening and thus limits the energy tolerance of the analyzer.

Figure 5:
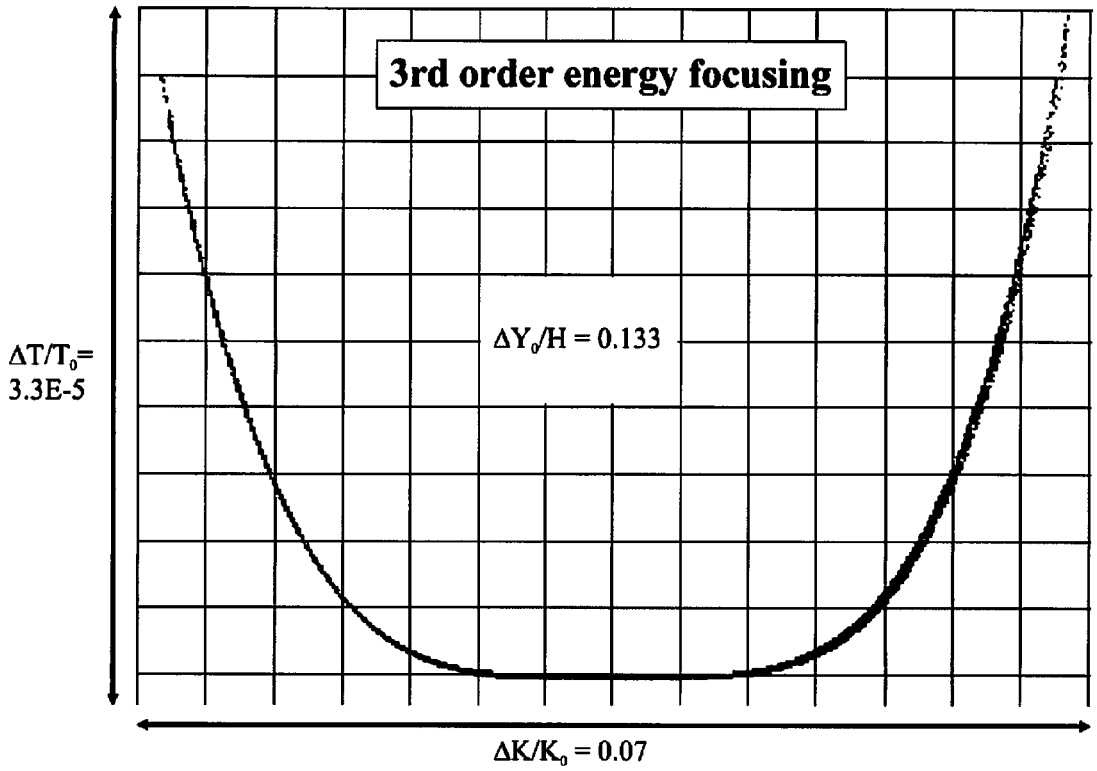
FIG. 5 shows typical flight time broadening as a function of ion energy at finite ionic Y-spatial spread in MPA-2 mirror at the MPA-2-3 tuning mode providing $3^{rd}$ order energy focusing.

Referring to FIG. 5, a plot of the flight time distribution in the time-energy plane is shown at a time focal plane after an even number of ion reflections by mirrors MPA-2 of FIG. 3, tuned to the third order energy focusing mode MPA-2-3, also providing complete third order focusing. Initial ion bunch has Gaussian energy distribution at $\sigma_K=0.011K_0$ and uniform Y-distribution at full height of $2Y_0=0.133H$, same as used for plotting FIG. 2. Due to elimination of the mixed third order aberrations, the points at the plot approximately follow the curve $(T-T_0)/T_0=(t|\delta\delta\delta\delta)\delta^4$, which means that the fourth order aberration $(t|\delta\delta\delta\delta)\delta^4$ dominates in flight time broadening. Comparing Tables 2 and 4, the mirror MPA-2 in the MPA-2-3 tuning mode has more than twice larger aberration coefficient (t|δδδδ) as compared to the mirror MPA-1, which again reflects the general trend: energy aberrations increase when tuning for lower third order mixed aberrations. Comparing FIG. 2 and FIG. 5, the time broadening is somewhat higher in FIG. 5 in spite of formally higher order overall focusing.

Figure 6:
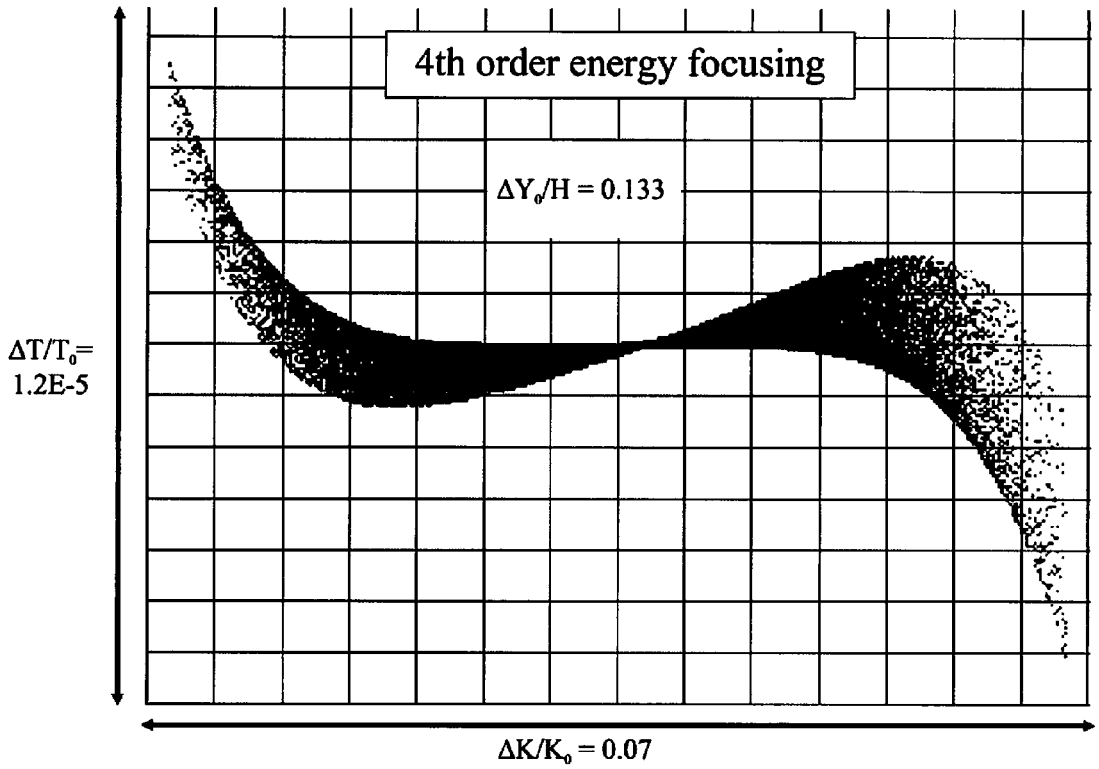
FIG. 6 shows typical flight time broadening as a function of ion energy at finite ionic Y-spatial spread in MPA-2 mirror at the MPA-2-4 tuning mode providing $4^{th}$ order energy focusing.

Referring to FIG. 6, a plot of the flight time distribution in the time-energy plane is shown at a time focal plane after an even number of ion reflections by mirrors MPA-2 of FIG. 3, tuned to the fourth order energy focusing mode MPA-2-4. Initial ion bunch has Gaussian energy distribution at $\sigma_K=0.011K_0$ and uniform Y-distribution at full height of $2Y_0=0.133H$, same as used for plotting FIG. 2 and FIG. 5. The plot evidently demonstrates some contribution of the non-vanishing aberration $(t|yy\delta)y_0^2\delta$. Similarly to FIG. 2, the points corresponding to individual ions are mostly enclosed between two curves: symmetric and tilted curves corresponding to $(T-T_0)/T_0=(t|\delta\delta\delta\delta\delta)\delta^5$ and $(T-T_0)/T_0=(t|\delta\delta\delta\delta\delta)\delta^5+(t|yy\delta)y_0^2\delta$. As seen from the plot, the $(t|\delta\delta\delta\delta\delta)\delta^5$ aberration dominates over $(t|yy\delta)y_0^2\delta$ aberration (subject to initial δ- and y-spreads). Thus, fourth order energy focusing allows 3 times smaller time spread compared to the third order energy focusing, being consistent with the plot of FIG. 4.

Figure 7:
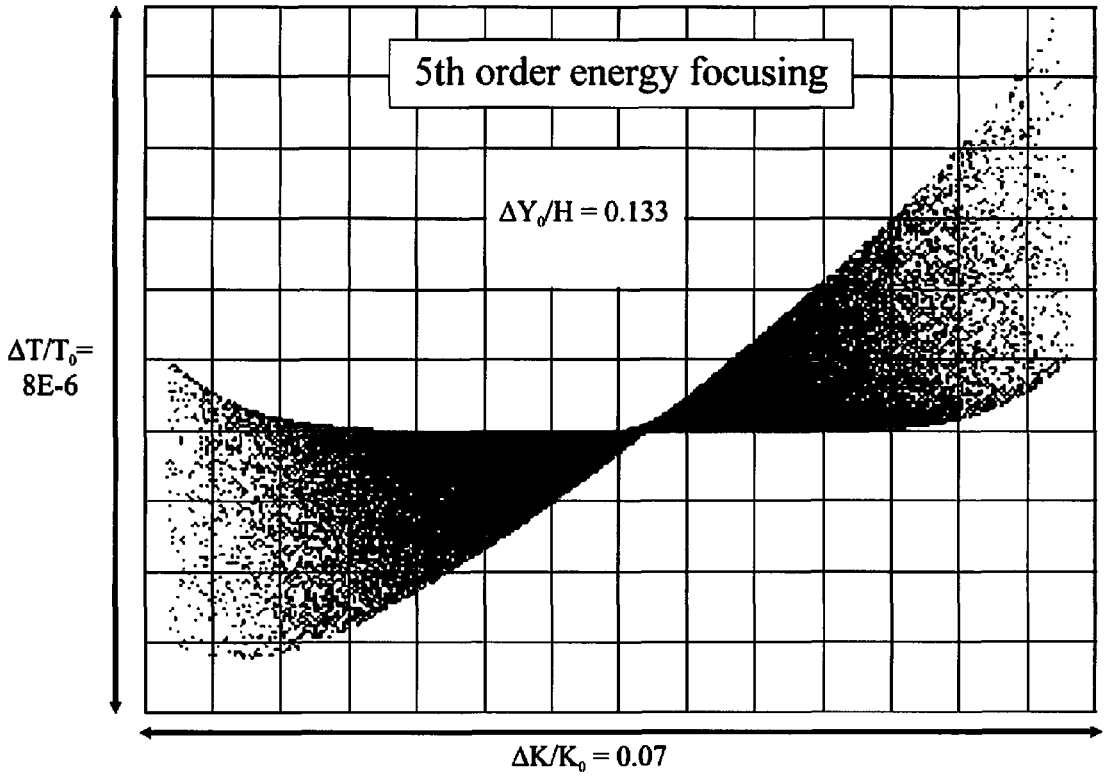
FIG. 7 shows typical flight time broadening as a function of ion energy at finite ionic Y-spatial spread in MPA-2 mirror at the MPA-2-5 tuning mode providing $5^{th}$ order energy focusing.

Referring to FIG. 7, a plot of the flight time distribution in the time-energy plane is shown at a time focal plane after an even number of ion reflections by the mirrors MPA-2 of FIG. 3, tuned to the fifth order energy focusing mode MPA-2-5. Initial ion bunch has Gaussian energy distribution at $\sigma_K=0.011K_0$ and uniform Y-distribution at full height of $2Y_0=0.133H$, same as used for plotting FIG. 2, FIG. 5 and FIG. 6. Similarly to FIG. 6, in FIG. 7 the points corresponding to individual ions are enclosed between two curves: symmetric and tilted curves corresponding to $(T-T_0)/T_0=(t|\delta\delta\delta\delta\delta\delta)\delta^6$ and $(T-T_0)/T_0=(t|\delta\delta\delta\delta\delta\delta)\delta^6+(t|yy\delta)y_0^2\delta$. However (unlike in FIG. 6), the contribution of the non-vanishing aberration $(t|yy\delta)y_0^2\delta$ becomes absolutely dominating. Switching between MPA-2-4 and MPA-2-5 modes improves time spread 1.5 times only, instead of ten-fold predicted by FIG. 4.

Therefore, in "typical" prior art ion mirrors consisting of two regions with reflecting and accelerating fields, improvement of time per energy focusing has limited effect on the resolving power and on the energy tolerance because of the inevitable and dominating third order mixed aberrations.

Mirror-lens Combinations of Present Invention

Figure 8:
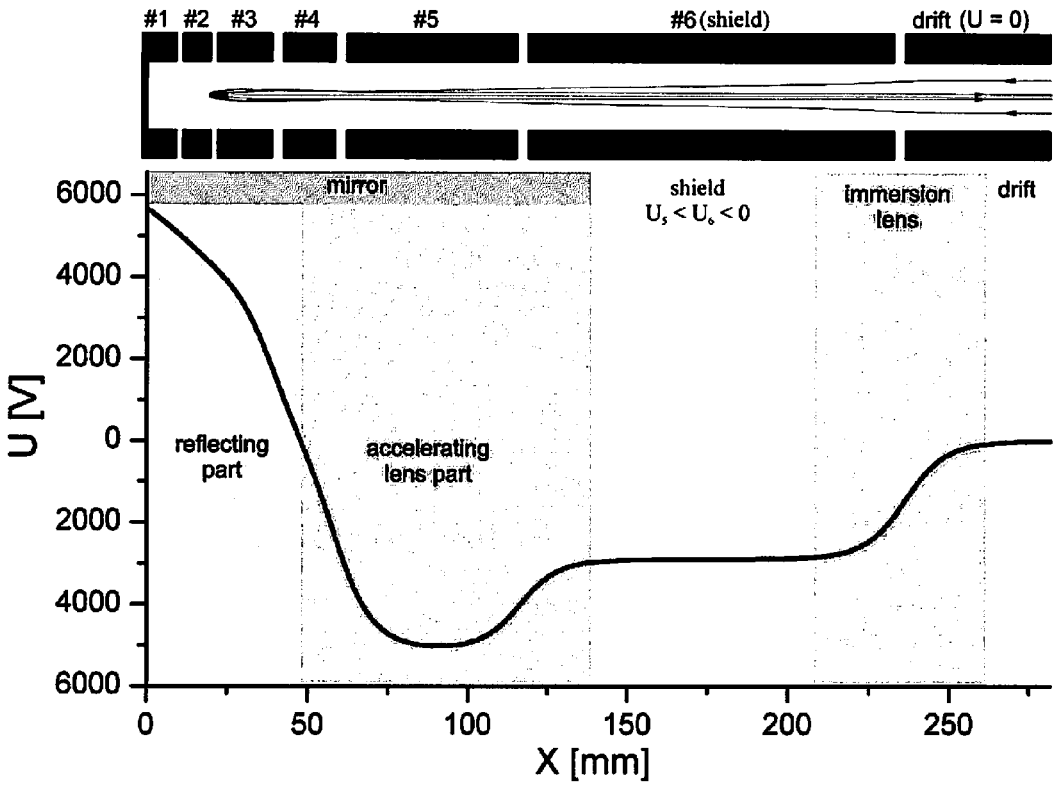
FIG. 8 depicts an ion mirror-lens combination (ML-1) of the present invention. The fourth order energy focusing is reached simultaneously with much smaller (compared to MPA-1 and MPA-2) mixed third order aberrations. Sample ion trajectories and electrostatic potential U(X, Y=0) distribution corresponds to $K_0/Q=4500$ V.

Referring to FIG. 8, a combination of a planar mirror and of a planar lens is shown in the XY-plane and denoted as ML-1. Both the ion mirror and the planar lens are substantially elongated in the Z-direction such that to form substantially two dimensional electrostatic fields in the XY-plane orthogonal to the Z-direction. A multi-reflecting time-of-flight analyzer comprises two such mirror-lens combinations, turned face-to-face and separated by a field-free drift space. For simulation purposes, drift potential is set to zero $U_D=0$. The mirror electrostatic field is formed by electrodes #1 to #5. Retarding voltages are applied to electrodes #1, #2 and #3, thus forming the reflecting mirror field. The electrode #4 is at drift potential ($U_4=U_D=0$). The highest accelerating voltage is applied to the electrode #5 for geometric ion focusing ($U_5<U_6$ for positive ions). The electrode #6 plays a role of the field-free shield for the mirror. This electrode is long enough such a field-free region of electrode #6 separates the mirror from the pre-focusing lens formed by applying $U_6<U_D$ (for positive ions). The potential at the electrode #6 is biased lower than the drift potential $U_D=0$, such that to form an immersion lens between the shield electrode #6 and the drift at the potential U=0. Such immersion lens accelerates ions moving towards the mirror. The sample ion trajectories shown in FIG. 8 demonstrate that on the way to the mirror ions are geometrically focused first by the immersion lens and then additionally by the lens formed in the accelerating field region of the ion mirror. The electrode widths and options of electric tuning are presented in Table 5. For the particular mirror-lens combination ML-1, the cap-to cap distance is $2X_0=836$ mm and the height of the mirror window is H=24 mm.

TABLE 5

| Geometry and electrode potentials for the mirror-lens combination ML-1 | | | | | | | |
|---|---|---|---|---|---|---|---|
| Electrode | | #1 | #2 | #3 | #4 | #5 | #6 |
| Normalized width, L/H | | 0.375 | 0.350 | 0.750 | 0.750 | 2.333 | 4.958 |
| Normalized potential, $UQ/K_0$ | $(t\|\delta) = (t\|\delta\delta) = (t\|\delta\delta\delta) = (t\|\delta\delta\delta\delta) = 0$ | 1.296 | 1.077 | 0.924 | 0 | −1.155 | −0.639 |
| | $(t\|\delta) \neq 0$, $(t\|\delta\delta\delta) \neq 0$ | 1.293 | 1.076 | 0.924 | 0 | −1.152 | −0.638 |

The mirror-lens combination ML-1 is designed such that the fourth order energy focusing $(t|\delta)=(t|\delta\delta)=(t|\delta\delta\delta)=(t|\delta\delta\delta\delta)=0$ is achieved together with negligibly small third order mixed aberrations, thus reaching the object of the invention.

Figure 9:
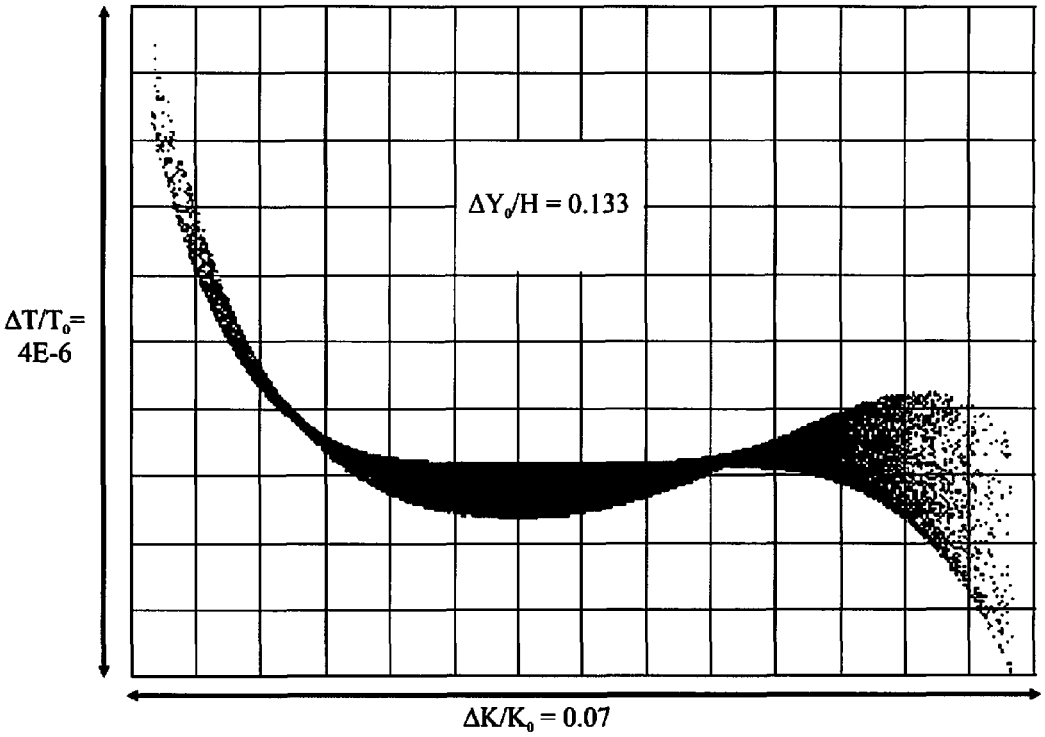
FIG. 9 shows typical flight time broadening as a function of ion energy at finite ionic Y-spatial spread in mirror-lens combination ML-1 of FIG. 8, tuned to compensate first trough fourth energy derivatives ($dT/dK=d^2T/dK^2=d^3T/dK^3=d^4T/dK^4=0$).

Referring to FIG. 9, a plot of the flight time distribution in the time-energy plane is shown at a time focal plane (located in the middle plane of the analyzer) after an even number of ion reflections from the mirror ML-1 of FIG. 8, for a bunch of ions with the same relative energy and Y-coordinate initial spreads as used for plotting FIGS. 2, 5-7 (Gaussian energy distribution at $\sigma_K=0.011K_0$ and uniform Y-distribution at full height of $2Y_0=0.133H$). The third order mixed aberration is nearly cancelled and the fifth order aberration $(t|\delta\delta\delta\delta\delta)\delta^5$ becomes dominating. As a result, the amplitude of flight time broadening becomes 3 times smaller compared to prior art analyzer with the fourth order energy focusing MPA-2-4 in FIG. 6.

Figure 10:
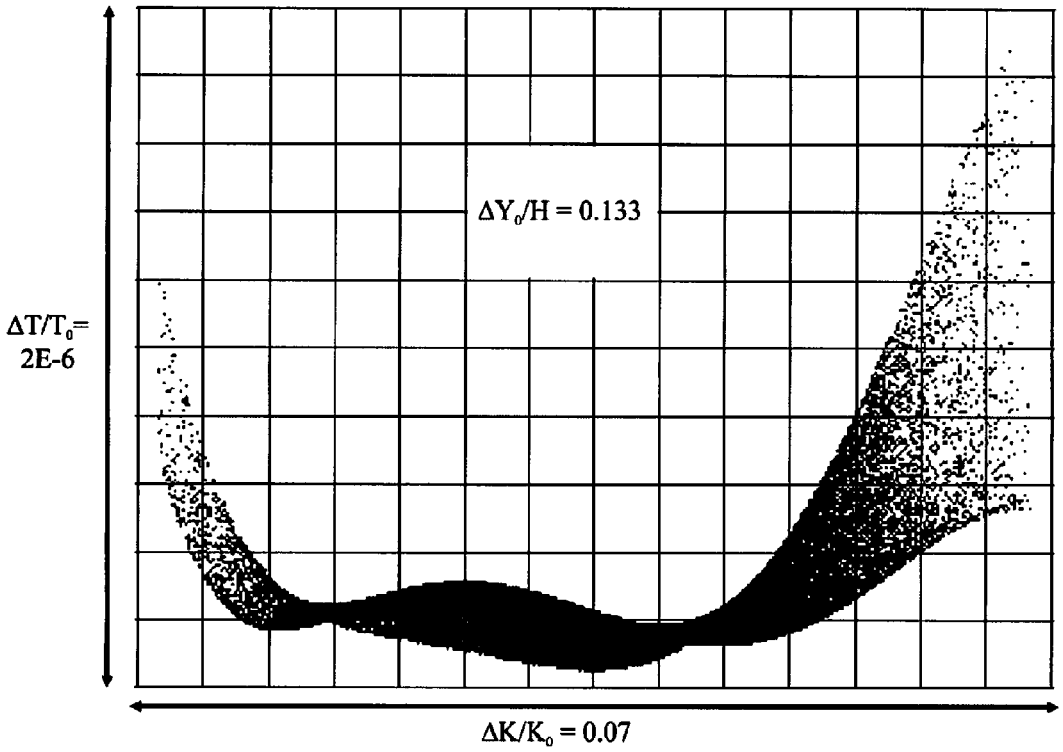
FIG. 10 shows typical flight time broadening as a function of ion energy at finite ionic Y-spatial spread in mirror-lens combination ML-1, at an alternative analyzer tuning corresponding to non-zero but partly mutually compensating first and third energy derivatives ($d^2T/dK^2=d^4T/dK^4=0$, $dT/dK\neq0$, $d^3T/dK^3\neq0$) to minimize the overall time broadening.

Referring to FIG. 10, a plot of the flight time distribution in the time-energy plane is shown at a time focal plane after an even number of ion reflections by the mirror ML-1, for a bunch of ions with the same energy and Y-coordinate initial spreads as used for plotting FIG. 9, but in case of a slightly different electric tune. With this "shifted" tune, the first and third order aberration coefficients $(t|\delta)$ and $(t|\delta\delta\delta)$ are not eliminated completely but tuned to some small values such that the amplitude of the flight time broadening is minimized for given energy spread. One possible option for such tune is to represent the dependence $t(\delta)$ by a fifth order Chebychev polynomial. For the plots of FIGS. 9 and 10, the corresponding electric tunes are presented in Table 5 and the values of relevant aberration coefficients are shown in Table 6. Comparing FIG. 9 and FIG. 10, the amplitude of the flight time broadening is twice smaller in the "shifted" tune.

TABLE 6

| Relevant aberration coefficients for two tunes of the mirror-lens combination ML-1 | | |
|---|---|---|
| | Value | |
| Aberration coefficient | $(t\|\delta) = (t\|\delta\delta) = (t\|\delta\delta\delta) = (t\|\delta\delta\delta\delta) = 0$ | $(t\|\delta) \neq 0$, $(t\|\delta\delta\delta) \neq 0$ |
| $(t\|\delta)$ | 0 | $-1.3 \times 10^{-5}$ |
| $(t\|\delta\delta)$ | 0 | 0 |
| $(t\|\delta\delta\delta)$ | 0 | 0.051 |
| $(t\|\delta\delta\delta\delta)$ | 0 | 0 |
| $(t\|\delta\delta\delta\delta\delta)$ | −37.1 | −37.1 |
| $(t\|\delta\delta\delta\delta\delta\delta)$ | 251.1 | 259.1 |
| $(t\|yy\delta)$ | 0.00297 | 0.00270 |

Figure 11:
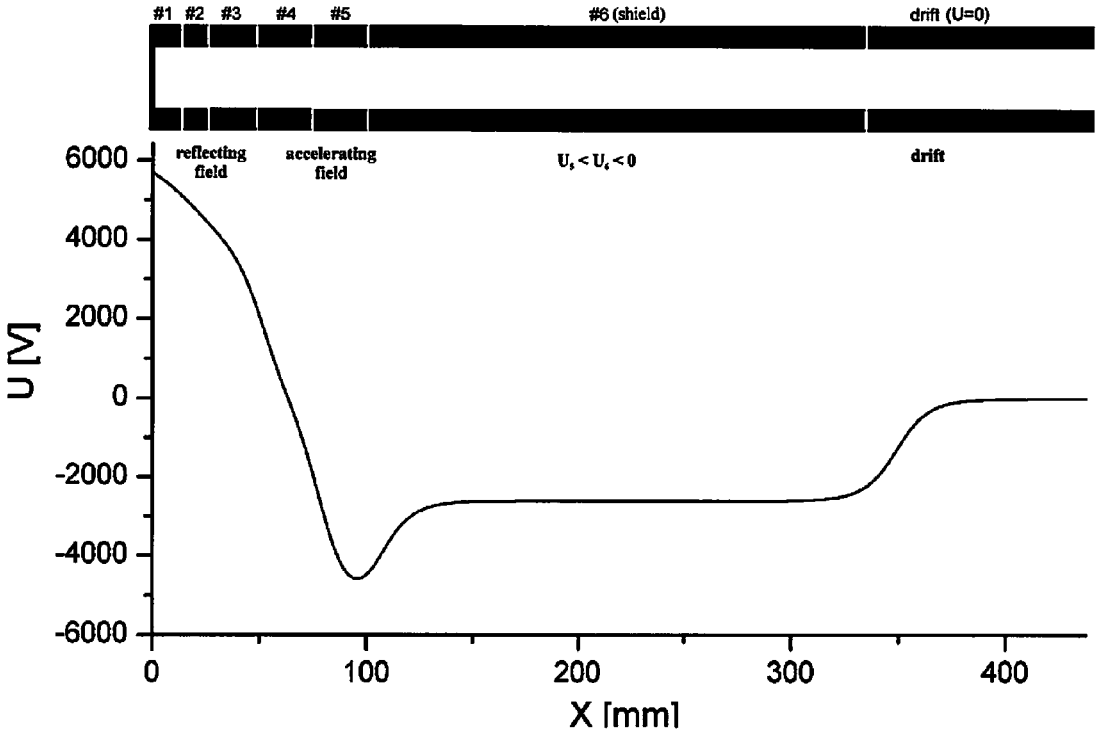
FIG. 11 depicts an ion mirror-lens combination (ML-2) of the present invention providing the fifth-order energy focusing and simultaneously eliminating mixed third order aberrations. Electrostatic potential U(X, Y=0) distribution are drawn for $K_0/Q=4500$ V.

Referring to FIG. 11, yet another geometry (ML-2) of a planar mirror combined with a planar lens is shown. In this combination, the separation distance from the mirror and the lens is considerably increased as compared to the geometry ML-1 (electrode #6 width normalized by the window height H is 8.10 in ML-2 as compared to 4.96 in ML-1), which allowed eliminating of third order mixed aberrations simultaneously with the fifth order energy focusing. The widths of all electrodes and the mode of electric tuning are given in Table 7. The absolute values of the cap-to-cap distance and of the mirror window height are $2X_0=1080$ mm and H=30 mm.

TABLE 7

| Geometry and electrode potentials for the mirror-lens combination ML-2 | | | | | | |
|---|---|---|---|---|---|---|
| Electrode | #1 | #2 | #3 | #4 | #5 | #6 |
| Normalized width, L/H | 0.458 | 0.423 | 0.82 | 0.917 | 0.917 | 8.100 |
| Normalized potential $UQ/K_0$ | 1.265 | 1.054 | 0.918 | 0 | −1.313 | −0.581 |

Figure 12:
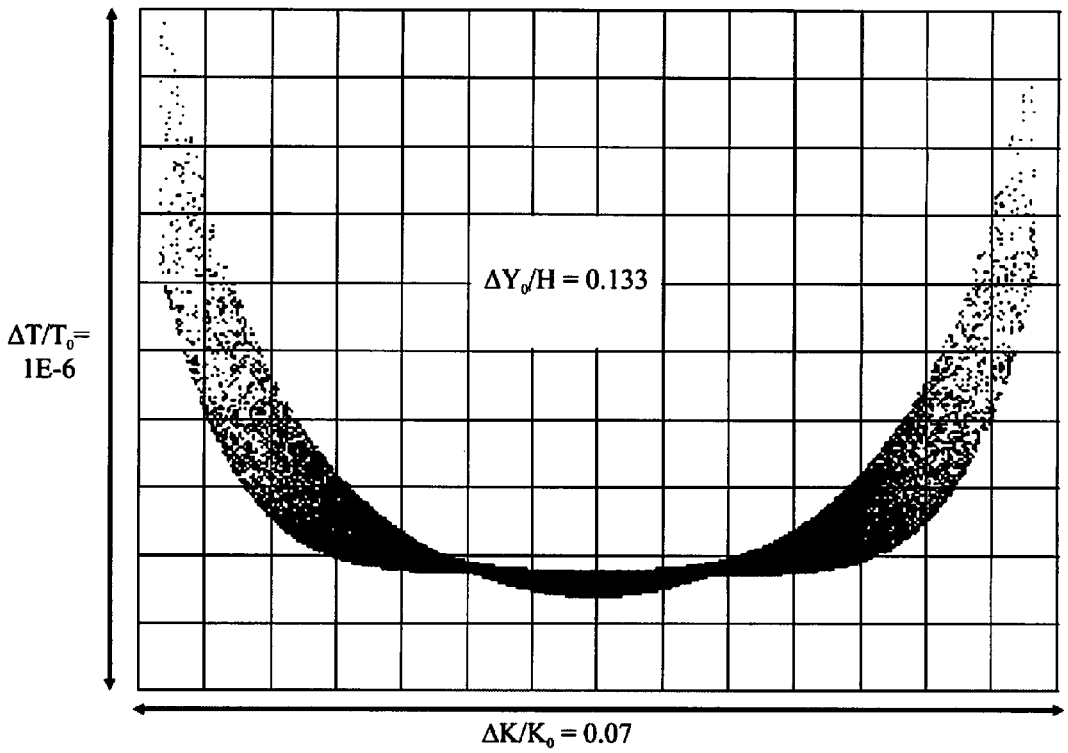
FIG. 12 shows typical flight time broadening as a function of ion energy at finite ionic Y-spatial spread in mirror-lens combination ML-2 of FIG. 11.

Referring to FIG. 12, a plot of the flight time distribution in the time-energy plane is shown at a time focal plane after an even number of ion reflections by the mirror ML-2 of FIG. 11, for a bunch of ions with the same energy and Y-coordinate initial spreads as used for plotting FIGS. 2, 5-7, 9 and 10 (Gaussian energy distribution at $\sigma_K=0.011K_0$ and uniform Y-distribution at full height of $2Y_0=0.133H$). As clearly seen the object of the invention is reached, i.e. normalized time spread amplitude is reduced down to $\Delta T/T_0<10^{-6}$. The amplitude of the flight time broadening became almost an order of magnitude smaller than in the prior art analyzer with the fifth order energy focusing mirror at MPA-2-5 tuning mode in (FIG. 7). As shown in Table 8, after eliminating the third order spatial aberration, third order mixed aberrations together with the fifth order energy aberrations, the time spread becomes dominated by higher order aberrations—the sixth order aberration $(t|\delta\delta\delta\delta\delta\delta)\delta^6$ and fourth order spatial aberrations.

TABLE 8

| Relevant aberrations of the analyzer with the mirror-lens combination ML-2 | |
|---|---|
| Aberration coefficient | Value |
| $(t\|\delta\delta\delta\delta)$ | 0 |
| $(t\|\delta\delta\delta\delta\delta)$ | 0 |
| $(t\|\delta\delta\delta\delta\delta\delta)$ | 466.0 |
| $(t\|yy\delta)$ | 0 |
| $(t\|yyyy)$ | 0.00408 |
| $(t\|yy\delta\delta)$ | 0.13 |

Figure 13:
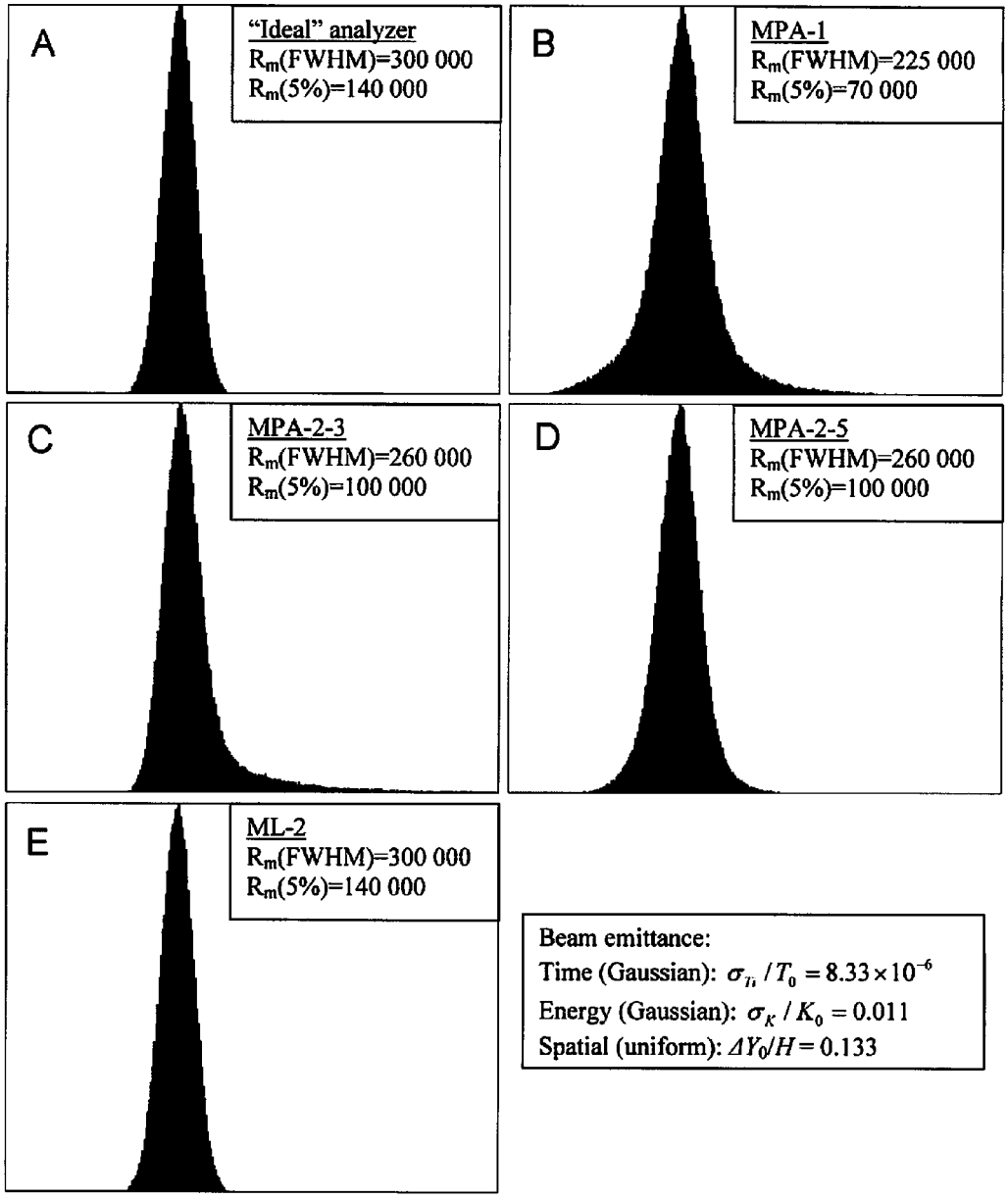
FIG. 13 presents a comparison of peak shapes for mass analyzers with different ion mirrors.

Referring to FIG. 13, influence of flight time aberrations on the shape of time-of-flight peaks is compared for different ion mirror designs. The peaks are simulated assuming initial time spread $\Delta T_i$ (usually defined by turn-around time in the ion source) with Gaussian distribution corresponding to mass resolving power $R_m=T_0/(2\Delta T_i)=300\,000$ at FWHM at the absence of flight time aberrations in the analyzer. The initial energy and spatial spreads in ion bunches are the same as used for plotting FIGS. 2, 5-7, 9, 10 and 12 (Gaussian energy distribution at $\sigma_K$=0.011$K_0$ and uniform Y-distribution at full height of $2Y_0$=0.133H). The horizontal scale is equal in all plots. FIG. 13-A shows the peak shape for an "ideal" analyzer possessing no time-of-flight aberrations (i.e. the mass peak shape is the same one as at the analyzer entrance). FIG. 13-B shows the peak shape for the MPA-1 prior art mass analyzer, possessing the third order energy focusing and the second-order spatial focusing. Ion mirror aberrations in this case contribute to both FWHM peak width and to the long peak tails. FIG. 13-C shows the peak shape for the MPA-2 prior art mass analyzer in the 3$^{rd}$ order full focusing mode MPA-2-3. Elimination of the third order mixed aberrations in this case reduces the FWHM peak width practically to the width of the "ideal" peak, but the fourth order energy aberration contributes to a very long tail on the right peak side. FIG. 13-D shows the peak shape for the MPA-2 prior art mass analyzer in the fifth order energy focusing mode MPA-2-5. As compared to FIG. 13-C, the long tail due to the energy spread disappears, but the non-vanishing third order mixed aberration still deteriorates the mass resolving power at small peak height. Finally, FIG. 13-E shows the peak shape in the mass analyzer with the mirror-lens combinations ML-2 of the present invention. In this analyzer, for given energy and spatial ion spreads the contribution of flight time aberrations is negligible and the peak shape is practically the "ideal" one.

Thus, the novel mirror-immersion lens combination allows reaching a super-high level of the mass resolving power in multi-reflecting time-of-flight analyzer both at FWHM and at low peak height levels, which has not been possible using prior art designs of gridless ion mirrors, which demonstrates reaching the goal of the invention.

Alternative and Supplementary Designs

Referring to FIG. 14, several geometric configurations 1 to 3 of the TOF analyzer of the present invention are shown at the level of block schematics. Basic symmetric configuration 1 employs mirror-lens combinations of FIGS. 8 and 11. The configuration 1 comprises two ion mirrors, each including a reflecting part 11 and the accelerating lens part 12, and two immersion lenses 13. Each lens 13 is separated from the corresponding accelerating mirror part 12 by a shield 14 creating a field-free space with the potential $U_S$ different from the drift potential $U_D$ in the space 15 between the immersion lenses 13. Another analyzer configuration 2 employs only one immersion lens 13, so that the analyzer comprises one ion mirror and one mirror-lens combination. Yet another analyzer configuration 3 employs one lens 16 such that the potentials $U_D$ at both sides of this lens are equal. In a sense the configuration 3 may be considered as a configuration 1 with a zero drift space length.

Again referring to FIG. 14, mirror-lens combinations can be further combined with an array of planar lenses as disclosed for a planar MR-TOF MS in GB2403063 and U.S. Pat. No. 5,017,780 by the authors, incorporated herein by references. In configuration 4 a periodic lens 17 focuses ions in the Z-direction. The lens 17 is located in the space 15 with the drift potential $U_D$. Note, that the periodic lens focuses ions in the direction which is perpendicular to the Y-direction of focusing by immersion lenses and by ion mirrors. In another configuration 5, electrostatic fields are superimposed for the planar lens 16 (focusing ions in Y-direction) and for periodic lens 17 (focusing ions in the Z-direction). Such superposition can form periodic lenses with 3D field, focusing ions in both transversal directions Y and Z.

In yet another embodiment (not shown), electrostatic field of one or both mirrors can be superimposed with a weak field being periodic in the Z-direction (direction of mirror elongation). Such spatial (not time) modulation of the ion mirror field in the Z-direction provides for ion confinement in the Z-direction as disclosed in US2011186729 by the authors, incorporated herein by reference. In another embodiment, such spatial periodic modulation of the ion mirror field is combined with the above described focusing by a periodic lens or by a spatially Z-modulated immersion lens, such that a combined Z-focusing allows mutual cancellation of major time-of-flight aberrations related to ion packet width in the Z-direction. The improved isochronicity of spatial focusing in the Z-direction is expected based on the analogy with the presently described spatial and time-of-flight focusing in the Y-direction.

The novel mirror-immersion lens combination substantially reduces analyzer aberrations. The above described isochronous geometrical focusing in the Z-direction is expected to further decrease the analyzer aberrations. Then the initial turn-around time is expected to define peak width. This makes practical the further extension of the flight path. In another embodiment, a mirror-lens combination may be implemented in a hollow cylindrical mass analyzer which provides an efficient trajectory folding relative to the analyzer size, as disclosed in co-pending applications U.S. Pat. No. 7,196,324, GB2476964, GB2477007, WO2011086430, and co-pending application 223322-313911 by the authors, incorporated herein by references. In this case, electrodes of the mirror-lens combination have a small (compared to the mirror window height) curvature in the drift direction Z. Combining hollow cylindrical symmetry with the novel mirror-immersion lens combination provides an additional effect, since the novel ion mirror has much higher tolerance to radial ion displacement, thus opening the way for high (half million to million range) of resolving power in cylindrical time-of-flight and electrostatic trap analyzers.

In yet another embodiment, electrostatic field of one or both mirrors of hollow cylindrical symmetry can be periodically (spatially and not in time) modulated in the tangential Z-direction in combination with either tangentially periodic lens in the field free space or with the tangentially periodically modulated immersion lens.

To further improve resolving power R with a target of R~1,000,000 one may reduce the turn round time by improved ion confinement within small (d=2-3 mm) bore gaseous ion guides, and by using higher acceleration energy in the analyzer, accompanied with the proportional increase in the acceleration field strength.

Let us make numerical estimates for a particular hollow cylindrical MR-TOF analyzer with ion mirrors of FIG. 11 at $2X_0$=1080 mm, window height H=30 mm, 2R=320 mm diameter of median surface and with a periodic lens at p=10 mm pitch. Such analyzer has 100 m flight path. The chosen parameters minimize effects of radial ion path deviation and satisfy criteria $R>2X_0/3$ and $R>50*2X_0*\alpha^2$, where $\alpha\sim p/2X_0$ is the ion trajectory inclination angle in the analyzer, as disclosed in WO2011086430 and co-pending application 223322-313911, incorporated by the reference. Preferably, the hollow cylindrical analyzer has at least one radial steering electrode for steering ions to the mean cylindrical surface at ion reflection point, as disclosed in the same applications. Those precautions in combination with the third order spatial focusing of the present invention would ensure minimal spatial aberrations of the cylindrical MR-TOF analyzer, assessed in our simulations being under $2\Delta T/T_0<1E-6$ for the earlier assumed ion packet spreads (Gaussian energy distribution at $\sigma_K=0.011K_0$ and uniform Y-distribution at full height of $2Y_0=0.133H$).

Let us estimate resolution limit which is set by the turn around time in the proposed cylindrical analyzer. At preferred acceleration energy of 8 kV, the maximal voltage (on fifth electrode) is about 18.5 kV, i.e. sufficiently small (<20 kV) to avoid electrical breakdown. Typical flight time of m/z=1000 amu ions is then calculated as $T_0$=2.5 ms. Accounting $\Delta K/K_0$~7% limit onto relative energy spread, set by the analyzer aberrations at R~1,000,000, the field strength in the orthogonal accelerator can be brought to E=400 V/mm at ΔX=1.5 mm continuous ion beam size. If using small bore quadrupole ion guides, the output beam diameter can be brought to approximately 0.3 mm for 1000 amu ions. The beam diameter past the ion guide can be estimated as $d\sqrt{4kT/qV_{RF}}$ for thermal energy kT=0.026 eV, $V_{RF}$=1000 V and parameter q=0.01 at 1000 amu which allows low mass cut off in quadrupole at 50 amu. At proper telescopic refocusing of continuous ion beam in front of the accelerator, and accounting conservation of phase space $\Delta X*\Delta V_x$ in electrostatic lens (between quadrupole and accelerator), the transverse velocity spread $\Delta V_x$ of 1000 amu ions in the orthogonal accelerator can be reduced about 5 fold (1.5 mm/0.3 mm) relative to thermal velocity and (accounting velocity in opposite directions) can be brought down to 24 m/s. Then the turnaround time in 400 V/mm pulsed field corresponding to A=4E+10 $m^2/s$ acceleration would induce turn around time $\Delta T_i=\Delta V_x/A$=0.6 ns. Accounting 2.5 ms flight time for 1000 amu ions in L=100 m MR-TOF, such turn around time is expected to limit the resolving power at about 2E+6 level. In other words, extension of flight path and increasing acceleration voltage in the cylindrical hollow analyzer does soften turn around time limitation and opens the opportunity of R>1E+6 in MR-TOF analyzers.

However, due to prolonged flight times in cylindrical MR-TOF, the expected duty cycle of the orthogonal accelerator becomes very low—between 0.1 and 0.2%, even with the method of double orthogonal extraction, disclosed in US2007176090, incorporated herein by reference. To remove the limiting link between the resolving power and the sensitivity of MR-TOF analyzers, preferably, the orthogonal accelerator should employ a method of frequent encoded pulsing disclosed in WO2011135477, incorporated herein by reference. Alternatively, in case of using the MR-TOF analyzer as a second stage of MS-MS tandem, the orthogonal accelerator may be preferably replaced by a linear ion trap with a pulsed radial ejection. The replacement becomes possible because of small intensity of parent ion beam which avoids space charge saturation in the pulsed trap and in the MR-TOF analyzer. Such trap should be oriented along the Z-axis, tilted by angle α/2 and followed by a deflector for ion steering at angle α/2, where the ion trajectory inclination angle in the analyzer is $\alpha\sim p/2X_0$, equal to 1/100 in the numerical example. Preferably, to avoid interference with ion trajectories and to reduce gas load onto the MR-TOF, the trap is followed by an isochronous curved inlet formed by electrostatic sectors as described in U.S. Pat. No. 7,326,925 by authors, incorporated herein by reference.

Coaxial Ion Mirrors

The improved ion mirrors scheme is applicable to coaxial multi-reflecting analyzers with a time-of-flight or image current detectors, disclosed in GB2080021, U.S. Pat. Nos. 5,017,780, 6,013,913A, U.S. Pat. Nos. 5,880,466, and 6,744,042, incorporated herein by reference. The cylindrical two-dimensional electrostatic field is known to provide very similar properties as planar two-dimensional field. Based on the above described ion optical studies it becomes obvious that at least a single focusing lens, and preferably an immersion lens is expected to improve spatial and energy acceptance of coaxial multi-reflecting analyzers. Such time-of-flight, or electrostatic trap analyzer should comprise: (a) two parallel and aligned grid-free coaxial ion mirrors separated by a filed free region, said mirrors being arranged to reflect ions in the coaxial direction; (b) said mirrors having at least one electrode with an accelerating potential compared to the field-free space potential; and (c) at least one electrostatic lens, arranged to focus ions in the radial direction and placed between said ion mirrors. Preferably, said at least one lens is immersion. Preferably, the mirror-immersion lens arrangement is symmetric.

Although the present invention has been describing with reference to preferred embodiments, it will be apparent to those skilled in the art that various modifications in form and detail may be made without departing from the scope of the present invention as set forth in the accompanying claims.

What is claimed is:

1. An isochronous time-of-flight, open trap, or electrostatic trap analyzer comprising:

two parallel and aligned grid-free ion mirrors separated by a field-free region, said ion mirrors arranged to reflect ions in a X-direction, said ion mirrors being substantially elongated in a transverse drift Z-direction to form a two-dimensional electrostatic field E(X,Y) either of a planar symmetry or of a hollow cylindrical symmetry, wherein said ion mirrors have at least one electrode with an accelerating potential as compared to a potential of the field-free region; and at least one electrostatic immersion lens, arranged to focus ions in a Y-direction and operable to accelerate ions in a first direction and decelerate ions in a second direction opposite the first direction, said at least one electrostatic immersion lens being elongated in said transverse drift Z-direction and placed between said ion mirrors.

2. The isochronous time-of-flight, open trap, or electrostatic trap analyzer as set forth in claim 1, wherein said at least one electrostatic immersion lens is of (i) planar symmetry; or (ii) hollow cylindrical symmetry.

3. The isochronous time-of-flight, open trap, or electrostatic trap analyzer as set forth in claim 1, wherein said at least one electrostatic immersion lens is formed by: a (i) set of pairs of flat electrodes with parallel surfaces; (ii) set of planar aperture slit electrodes; (iii) set of pairs of coaxial ring electrodes; or (iv) set of coaxial ring-shaped aperture slits.

4. The isochronous time-of-flight, open trap, or electrostatic trap analyzer as set forth in claim 1, wherein the number of said at least one electrostatic immersion lens is two.

5. The isochronous time-of-flight, open trap, or electrostatic trap analyzer as set forth in claim 4, wherein said two electrostatic immersion lenses are separated from said two-dimensional electrostatic field E(X,Y) as well as from each other by a field-free space.

6. The isochronous time-of-flight, open trap, or electrostatic trap analyzer as set forth in claim 5, wherein ions pass the field-free space separating said immersion lenses and said mirrors at higher kinetic energies than the field-free space between said immersion lenses.

7. The isochronous time-of-flight, open trap, or electrostatic trap analyzer as set forth in claim 1, further comprising a set of periodic lenses residing between said ion mirrors for confining ions in said direction of elongation.

8. The isochronous time-of-flight, open trap, or electrostatic trap analyzer as set forth in claim 7, wherein said at least one electrostatic immersion lens is superimposed with said set of periodic lenses forming a set of lenses focusing ions in two transversal directions.

9. The isochronous time-of-flight, open trap, or electrostatic trap analyzer as set forth in claim 1, wherein at least one mirror of said ion mirrors has a feature providing weak field being periodic in the direction Z of elongation of the mirror.

10. The isochronous time-of-flight, open trap, or electrostatic trap analyzer as set forth in claim 1, further comprising an orthogonal accelerator with encoded frequent pulsing.

11. The isochronous time-of-flight, open trap, or electrostatic trap analyzer as set forth in claim 1, further comprising a radial pulsed linear ion trap and a curved electrostatic sector inlet.

12. An isochronous time-of-flight or electrostatic trap analyzer comprising:

two parallel and aligned grid-free coaxial ion mirrors separated by a field-free region, said coaxial ion mirrors being arranged to reflect ions in the coaxial direction;

at least one electrode with an accelerating potential compared to the field-free region potential, said at least one electrode is part of said coaxial ion mirrors; and at least one electrostatic immersion lens, arranged to focus ions in the radial direction and placed between said coaxial ion mirrors, said at least one electrostatic immersion lens operable to accelerate ions in a first direction and decelerate ions in a second direction opposite the first direction.

13. A method for constructing an isochronous time-of-flight, open trap, or electrostatic trap analyzer comprising:

arranging two grid-free ion minors in a parallel manner such that a field-free region is created between said two grid-free ion mirrors, wherein said two grid-free ion mirrors are arranged to reflect ions in a X-direction, and wherein said two grid-free ion mirrors have at least one electrode with an accelerating potential as compared to a potential of the field-free region;

aligning the two ion mirrors such that a substantially elongated dimension of the two grid-free ion mirrors are aligned in a transverse drift Z-direction to form a two-dimensional electrostatic field E(X,Y) either of a planar symmetry or of a hollow cylindrical symmetry; and arranging at least one electrostatic immersion lens between said two grid-free ion mirrors to focus ions in a Y-direction and operable to accelerate ions in a first direction and decelerate ions in a second direction opposite the first direction, said at least one electrostatic immersion lens being elongated in said transverse drift Z-direction.

14. The method as set forth in claim 13, wherein said at least one electrostatic immersion lens is of (i) planar symmetry; or (ii) hollow cylindrical symmetry.

15. The method as set forth in claim 13, wherein said at least one electrostatic immersion lens is formed by: a (i) set of pairs of flat electrodes with parallel surfaces; (ii) set of planar aperture slit electrodes; (iii) set of pairs of coaxial ring electrodes; or (iv) set of coaxial ring-shaped aperture slits.

16. The method as set forth in claim 13, wherein the number of said at least one electrostatic immersion lens comprises at least two electrostatic immersion lenses.

17. The method as set forth in claim 16, wherein said at least two electrostatic immersion lenses are separated from said two-dimensional electrostatic field E(X,Y) as well as from each other by a field-free space.

18. The method as set forth in claim 17, wherein ions pass the field-free space separating said two-dimensional electrostatic field E(X,Y) at higher kinetic energies than the field-free space between said at least two electrostatic immersion lenses.

19. The method as set forth in claim 13, further comprising arranging a set of periodic lenses between said two grid-free ion mirrors, wherein said set of periodic lenses are arranged for confining ions in said direction of elongation.

20. The method as set forth in claim 19, wherein said at least one electrostatic immersion lens is superimposed with said set of periodic lenses forming a set of lenses focusing ions in two transversal directions.

21. The method as set forth in claim 13, wherein at least one mirror of said two grid-free ion mirrors has a feature providing weak field being periodic in the direction Z of elongation of the at least one mirror.

22. The method as set forth in claim 13, further comprising providing an orthogonal accelerator with encoded frequent pulsing.

23. The method as set forth in claim 13, further comprising providing a radial pulsed linear ion trap and a curved electrostatic sector inlet.

* * * * *